US005154539A

United States Patent [19]

McCown, Sr. et al.

[11] Patent Number: 5,154,539

[45] Date of Patent: Oct. 13, 1992

[54] FOUNDATION LIFTING AND STABILIZING APPARATUS

[76] Inventors: William B. McCown, Sr., Rte. 5, Box 410; Samps H. McCown, Rte. 5, Box 70C, both of Ada, Okla. 74820

[21] Appl. No.: 761,698

[22] Filed: Sep. 18, 1991

[51] Int. Cl.[5] ..... E02D 7/20

[52] U.S. Cl. ..... 405/230; 405/232; 254/29 R

[58] Field of Search ..... 405/229, 230, 231, 232, 405/251, 252.1; 52/126.1, 126.3; 254/29 R

[56] References Cited

U.S. PATENT DOCUMENTS

| | | | |
|---|---|---|---|
| 2,982,103 | 5/1961 | Revesz et al. . | |
| 3,796,055 | 3/1974 | Mahony | 254/29 R X |
| 3,852,970 | 12/1974 | Cassidy | 254/29 R X |
| 4,070,867 | 1/1978 | Cassidy | 405/230 |
| 4,678,373 | 7/1987 | Langenbach. Jr. | 405/230 |
| 4,695,203 | 9/1987 | Gregory | 405/230 |
| 4,708,528 | 11/1987 | Rippe | 405/230 |
| 4,925,345 | 5/1990 | McCown et al. | 405/230 X |
| 5,013,190 | 5/1991 | Green | 405/230 |
| 5,018,905 | 5/1991 | Kindes | 405/230 |

*Primary Examiner*—Dennis L. Taylor
*Assistant Examiner*—Arlen L. Olsen
*Attorney, Agent, or Firm*—Moore & Hansen

[57] ABSTRACT

The present invention provides a foundation shoring and stabilizing apparatus comprising a support bracket extending longitudinally under the structure to be supported, a yoke assembly disposed in a vertically spaced relationship above the support bracket, a lifting cradle engageable upon the bottom surface of the support bracket, a pair of generally upright members to which the lifting cradle and yoke assembly are removably attached, and a pile driving means attached to the yoke assembly and engageable upon a piling to be driven into the ground into a supporting relationship with the support bracket and the foundation.

18 Claims, 3 Drawing Sheets

FOUNDATION LIFTING AND STABILIZING APPARATUS

The present invention relates generally to apparatus for stabilizing, shoring, and raising foundations of structures in need of such support, such as buildings, roads, or the like, and relates particularly to apparatus useful in a confined area and for use relative to interior wall structures.

BACKGROUND OF THE PRESENT INVENTION

Equipment for shoring and stabilizing a sagging or settling building foundation is readily commercially available and operates along the following general principles. The equipment is disposed in an excavation adjacent to the foundation to be stabilized. A lifting or supporting bracket forms part of the equipment and extends under the foundation. A power means, such as an hydraulic cylinder, is attached to the equipment and is utilized to drive individual pier-pipes successively into the ground to form an elongate piling reaching to bedrock. In response to the downwardly directed driving force exerted by the power means, an upwardly directed reaction force is exerted on the support bracket and thus the foundation. While driving the piling to bedrock, the upwardly directed reaction force is generally insufficient to raise the foundation. When the piling reaches bedrock, however, the upwardly directed reaction force will be substantially equal to the downwardly directed driving force since the piling cannot be driven more deeply and the power means will be working against the bedrock through the piling. The power means will therefore be acting to raise the equipment, including the support bracket, upward rather than to drive the piling downward. Thus, an upwardly directed force substantially equal to the driving force of the power means will be exerted on the support bracket and consequently also on the foundation. The foundation can be lifted to its desired position by this lifting force as exerted through the bracket and the bracket can then be permanently affixed to the piling by welding or other known means to shore the foundation permanently.

The known equipment is generally designed for outside use, that is, external to the outside walls of a building or other structure. Occasionally, the wall to be stabilized will be leaning inwardly due to pressure exerted upon it by the surrounding soil and shoring from the exterior side may create a danger of the wall collapsing inwardly. This is especially so since the lifting force will almost never be directed completely parallel to the vertical axis of the wall and thus will likely exert at least a small inwardly directed tipping force or torque on the wall.

Additionally, when the foundation or wall being supported is a house basement foundation or wall, for example, shoring from the exterior of the structure will often require an excavation in depth equal to the floor to ceiling height of the basement. It would be easier in many instances to shore the foundation or wall from the inside of the house where the excavation need only begin at the floor of the basement and go to sufficient depth to insert the support bracket beneath the foundation. The lifting and shoring operation can begin with a substantially smaller excavation if the operation begins inside the structure rather than outside of it.

Thus, shoring and stabilizing a wall from the inside of a structure is often preferable to doing so from the outside thereof. Additionally, occasionally interior walls, especially load-bearing walls, are in need of further support. Since the known equipment is designed, built, and constructed generally for stabilizing exterior walls from the outside thereof, such equipment is often not easily moved into the interior of the structure because of its size and weight. The known equipment is also generally intended for use where large excavations are not any particular problem, which is certainly not the case when shoring is done from the inside. Few homeowners appreciate a large-scale excavation in their basement with the attendant dirt being tracked throughout the home.

It would therefore be desirable to have apparatus that was easily portable, lightweight, and able to operate with a minimum excavation.

SUMMARY OF THE PRESENT INVENTION

There is provided by the present invention an apparatus for stabilizing and supporting a structure such as a building foundation or wall, road bed, or other structure, that is subject to sagging, settling, or the like. The apparatus includes a support bracket that extends generally horizontally under the structure to be supported and that includes guide for receiving and guiding pier-pipes to be driven into the ground to form an elongate support piling; a pair of generally upright support members having a longitudinal axis and extending on opposite sides of the support bracket; a yoke assembly engaging the upright members and including a power means such as a fluid actuated hydraulic cylinder attached thereto so that the cylinder piston rod is extended substantially downward on the power stroke of the cylinder, the end of the piston rod including means for drivingly engaging the tops of the pier-pipes; and a pile-driving, reaction-force transmission means that extends between the upright members below the support bracket, that engages the bottom of the support bracket at a location between the structure and the piling, and that exerts a lifting force on the support bracket.

In a preferred embodiment, the generally upright members each includes a plurality of holes extending therethrough in substantial, spaced alignment with each other and transverse to the longitudinal axis of the upright members. The holes receive a yoke pin. The yoke assembly in the preferred embodiment has two pairs of spaced apart wing members, each pair receiving one of the upright members therebetween. The wing members of the yoke include a means for engaging the yoke pin. The means may include aligned semi-circular notches disposed in the top sides of the wing members that are engaged by the yoke pin. The means for engaging may also include aligned through holes such that the yoke pin is inserted through aligned wing member, upright member, and wing member holes. The yoke and its engagement with the upright members through the yoke pins provides a reference point for the application of the driving reaction forces.

The reaction force transmission means includes a lifting cradle having a transverse member that liftingly engages the bottom of the support bracket. The lifting cradle further includes attachment means for removably attaching the cradle to the upright members. In an alternative embodiment, the reaction force transmission means includes a lifting plate rigidly attached to the support bracket and removably attached to the upright members so that, when the upright members are forced upwardly by the downward stroke of the cylinder piston rod after the piling has engaged the bedrock, the lifting force will be transmitted through the plate to the support bracket and then to the structure to be stabilized.

These and other features and advantages of the present invention will become apparent to those skilled in the art when the following detailed description of the invention is read in conjunction with the accompanying drawings and claims. Throughout the drawings, like numerals refer to similar or identical parts.

DETAILED DESCRIPTION OF THE INVENTION

Figure 1:
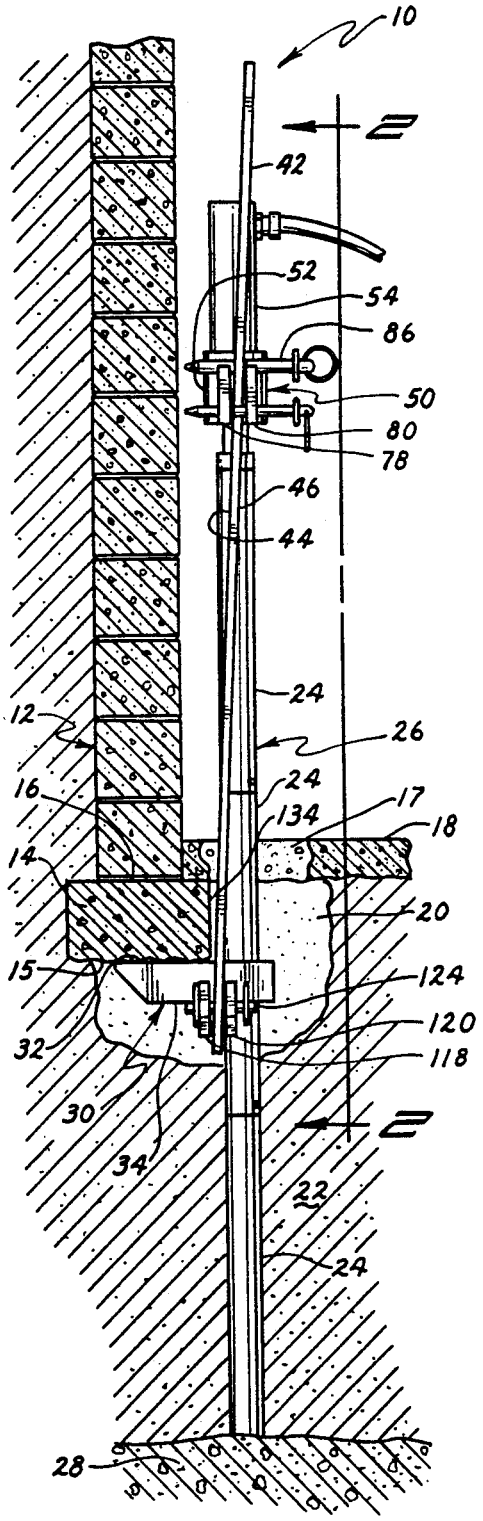
FIG. 1 is a side elevation view of a lifting and stabilizing apparatus in accord with the present invention with the apparatus shown positioned in an excavation adjacent to a settling foundation and with the support bracket thereof disposed to exert a lifting force on the foundation and wall thereabove.

FIG. 1 shows a lifting and stabilizing apparatus 10 in accordance with the present invention operatively positioned relative to a sagging or settling wall 12 and underlying foundation 14 having a bottom surface 15 and a top surface 16 that supportingly engages wall 12. Apparatus 10 has been positioned relative to wall 12 by inserting it through an opening 17 in floor 18 and into the accompanying excavated area 20 of the subsoil 22 underlying floor 18 and foundation 14. Apparatus 10 is used to drive successively a series of individual pier-pipes 24 into the ground 22 to form collectively an elongate support piling 26 that will be driven to bedrock 28 along a substantially vertical driving axis to provide a firm shoring for the foundation 14 and wall 12. Pier-pipes 24 can be attached in any known manner to form piling 26, such as that shown in U.S. Pat. No. 4,925,345 to McCown, Jr. et al, which is assigned to Powerlift Foundation Repair. As shown, each of the pier-pipes 24 has a substantially tubular configuration, though other cross-sectional configurations, such as I-beam or square, are within the scope of the present invention.

Lifting apparatus 10 includes a support bracket 30 having a top surface 32 and a bottom surface 34. Top surface 32 liftingly engages the bottom surface 15 of foundation 14. Support bracket 30 further includes a bore 36, best seen in FIG. 3, that receives and guides piling 26 as it is driven to bedrock by lift apparatus 10. As shown in the Figures, bore 36 has a substantially cylindrical configuration to match the cylindrical configuration of the piling 26. Other pier-pipe configurations are equally useful with the present invention, however, as previously noted, and thus bore 36 may take on the appropriate matching configuration.

Lifting apparatus 10 further comprises a pair of spaced apart, substantially identical, elongate, upwardly extending members 40 and 42. Members 40 and 42 each preferably have a substantially rectangular cross sectional configuration, although other shapes may be utilized. Members 40 and 42 each have front and rear surfaces 44 and 46, respectively, and a plurality of holes 48 extending through members 40 and 42 from front surface 44 to rear surface 46. Holes 48 are disposed in substantial alignment with each other along the longitudinal axis of members 40 and 42.

Figure 3:
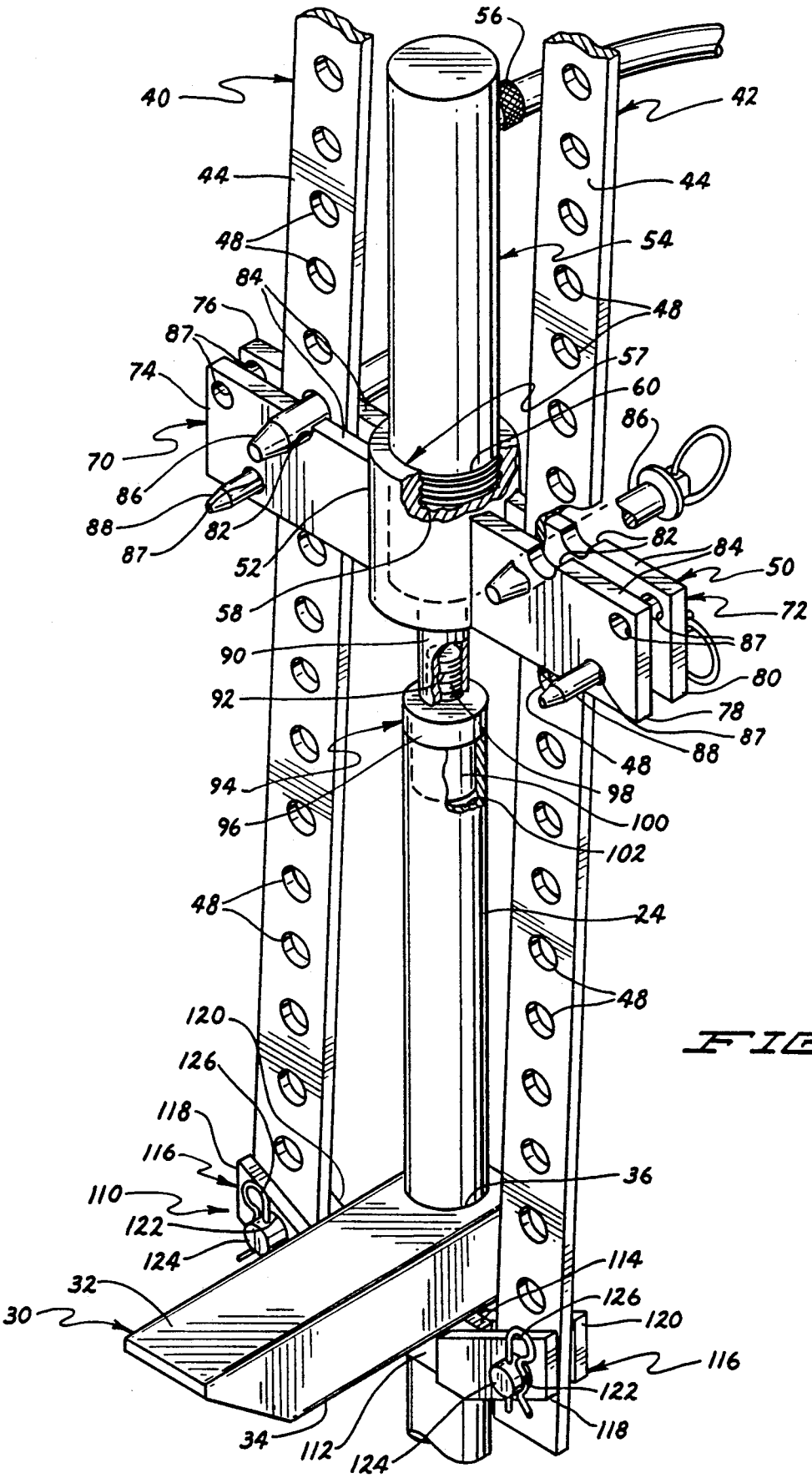
FIG. 3 is a front, downward-looking perspective view of the invention shown in FIGS. 1 and 2.
Figure 4:
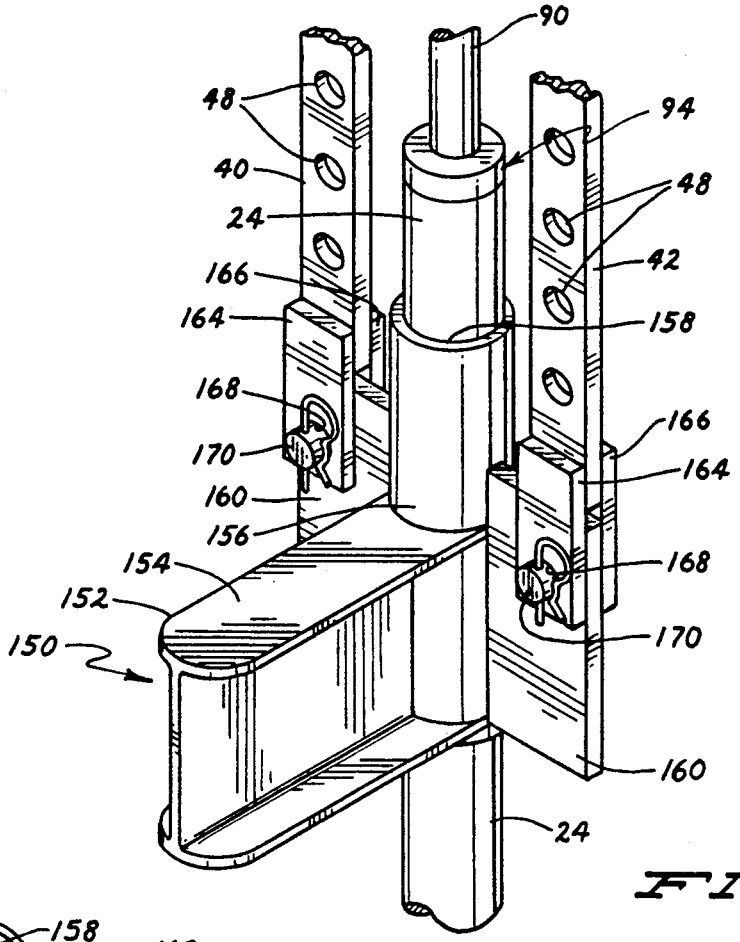
FIG. 4 illustrates in a partial perspective view another embodiment of the present invention including an integral support bracket and lifting means.
Figure 6:
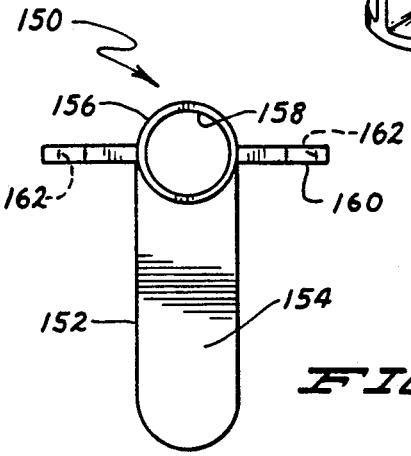
FIG. 6 is a top plan view of the integral support bracket and lifting means shown in FIG. 4.
Figure 5:
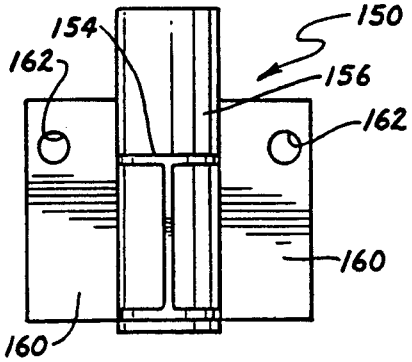
FIG. 5 is a front elevation view of the integral support bracket and lifting means shown in FIG. 4.
Figure 7:
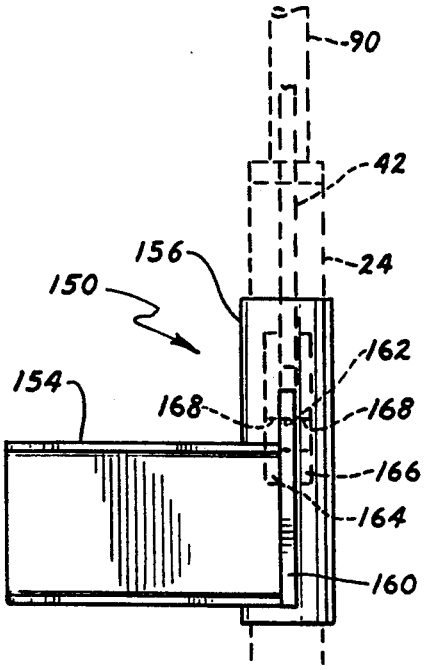
FIG. 7 is a side elevation view of the integral support bracket and lifting means shown in FIG. 4.

Members 40 and 42 cooperate to support a yoke assembly 50 upwardly relative to support bracket 30. Yoke assembly 50 includes a means 52 for engaging and supporting a pile driving means 54, such as the power cylinder shown. Power cylinder 54 has an elongate axis in substantial alignment with the aforesaid vertical driving axis and may be a single action, fluid actuated, hydraulic cylinder having a single input/output port 56 as shown, or it may comprise a double acting, fluid actuated hydraulic cylinder as is well known in the art. Means 52 comprises a sleeve 57 have an internally threaded bore 58 for threadably engaging a threaded end 60 of power cylinder 54, all as best seen in FIG. 3.

A pair of wings 70, 72 extends radially outwardly from opposite sides of means 52. Each wing 70, 72 comprises a pair of substantially horizontally extending, rectangularly cross sectionally configured bracket arms 74, 76 and 78, 80, respectively. Each arm is rigidly affixed to means 52 by welding or other known methods of attachment. Each arm 74–80 includes a semicircular notch 82 disposed in the top surface 84 thereof. The notches 82 each engage a pin 86 inserted through a hole 48 of either member 40 or 42. Preferably the pins 86 are inserted in substantially horizontally aligned holes 48 in members 40 and 42. Each arm further includes an aperture 87 through which a pin 88 extends. Pins 88 act as stop means to restrain members 40 and 42 from pivoting outwardly around their pinned attachment to lifting cradle 110 to be described below.

A piston rod 90 of power cylinder means 54 extends through bore 56 of sleeve 57 and downwardly from the bottom of support means 52. Piston rod 90 has an internally threaded end bore 92 that threadably engages an interchangeable piling adapter 94. Adapter 94 includes a base member 96 from which a threaded shaft 98 extends upwardly and a pier-pipe fitting 100 depends downwardly. Threaded shaft 98 is releasably, threadably received by end bore 92 to removably affix piling adapter 94 to piston rod 90. Pier-pipe fitting 100 may have a variety of configurations. As shown, fitting 100 has a substantially cylindrical configuration adapted to mateably engage the cylindrically configured internal bore 102 of the pier-pipe 24 that is engaged for driving by lifting apparatus 10. When pier-pipes having other configurations are used to form a piling, fitting 100 may be appropriately configured in a known manner to securely engage such other configured pier-pipes. Thus, adapter 94 enables lifting apparatus 10 to be used with a variety of differently configured pier-pipes.

Lifting apparatus 10 further includes a lifting cradle 110. Cradle 110 includes a transverse lifting member 112 having an upper surface 114 that liftingly engages the bottom surface 34 of support bracket 30 during shoring operations. Lifting cradle 110 further includes a pair of attachment means 116 that extend from opposite sides of lifting member 112 and between member 112 and either upright member 40 or 42 to attach lifting cradle 110 thereto. Each attachment means 116 comprises a pair of plates 118, 120 that are rigidly affixed on opposite sides of member 112 by means such as welding. Plates 118 and 120 are therefore spaced apart to receive therebetween either member 40 or 42. Plates 118 and 120 include mutually aligned through holes 122 that receive a pin 124 to removably attach lifting cradle 110 to upright members 40, 42. Pins 124 extend through substantially horizontally aligned holes 48 of members 40 and 42. Pins 124 may include keys 126 to prevent unwanted removal of pin 124 from through holes 122 during pile driving operations.

Preferably notches 82 and holes 122 in plates 118 and 120 will be spaced laterally the same distance apart so that when apparatus 10 is assembled as shown in the Figures, upright members 40 and 42 will be substantially parallel. This will reduce wear on notches 82. If desired, through holes may be used in lieu of notches 82.

Referring now to FIG. 1, in operation, a downwardly directed force will be exerted on piling 26 by driving means 54 in a downward direction along a vertical driving axis 130 coinciding with the central, longitudinal axis of piling 26. This downward force will push the piling 26 into the ground. During the downward push of piston rod 90, an upwardly directed, resistive force 132 opposite to the direction of force 130 will be exerted by the piling 126 through the piston rod 90 and thus through the yoke assembly 50 against transversely extending pins 86. This upward force will tend to push members 40 and 42 and thus also lifting cradle 110, upwardly. An upward force will be exerted by cradle 110 against support bracket 30 and thereby also against foundation 14. Until bedrock 28 is reached by piling 26, however, the piling will be pushed downward by apparatus 10 rather than foundation 14 being lifted upward.

When the cylinder piston rod 90 reaches full extension, the force exerted on the piston rod will cease, that is the fluid pressure acting on the piston within means 54 will be reduced substantially to zero by the operation of a valve, not shown. When fluid pressure ceases, the upward force will also cease and driving means 54 will tend to sink downward under its own weight until piston rod 90 has been substantially retracted within cylinder means 54. At that point in time, pins 86 will be pulled from their particular hole 48 and moved downward to the hole just above newly positioned notches 82 for the successive extension of piston rod 90. Preferably, notches 82 and through holes 122 in lifting cradle 110 are on the same centers so as to transmit resistive force 132 parallel to the aligned through holes and thus to avoid uneven wear on notches 182 and through holes 122. When each individual pier-pipe 24 has been driven by cylinder 54 a desired distance into the earth, but not farther than top surface 32 of support bracket 30, yoke assembly 50 will be lifted upwardly, a new pier-pipe will be attached to the previously driven pier-pipe and driving operations will be resumed. Whether successive extensions of piston 90 are necessary to drive a pier-pipe to a desired depth will depend on several factors, among them the relative lengths of the pier-pipes and the stroke of piston 90. If a pier-pipe is longer than the piston stroke, successive extension will be necessary. If shorter, only one extension of the piston may be necessary to drive the pier-pipe to the desired depth. Both circumstances fall within the scope of the present invention. Until bedrock 28 is reached by the lower end of the piling, the successive extension of the cylinder piston rod 90 will drive successive pier-pipes downwardly to form the piling 26.

When bedrock is reached by the lower end of the piling, driving the piling lower into the ground will be virtually impossible. As a result, extension of piston rod 90 will result in a lifting force substantially equal to the downward force exerted by the cylinder piston rod 90 being exerted against yoke 50 and therefor pins 86, members 40 and 42 and support bracket 30 through cradle 110. The lifting force will be transmitted to foundation 14 and wall 12 by the engagement of the top surface 114 of transverse lifting member 112 and the bottom surface 34 of support bracket 30. This upwardly directed lifting force will result in foundation 14 and wall 12 being lifted as desired. When the lifting operation is complete, i.e., when the foundation has been lifted to the desired height, support bracket 30 will be welded or otherwise permanently affixed to piling 26 and piling 26 will be cut off above top surface 32 of bracket 30 so as not to protrude above the floor 18. Lifting cradle 110 can then be unpinned from upright members 40 and 42 and removed along with members 40, 42 and yoke assembly 50 for use at a new location.

As best seen in FIGS. 1 and 3, lifting cradle 110 is attached to members 40 and 42 such that transverse lifting member 112 is disposed between piling 26 and foundation 14 during a lifting operation. Thus, the lifting force exerted against support bracket 30 will be disposed almost directly underneath the closest side 134 of foundation 14 to apparatus 10. The lifting force is thus closer to the object to be lifted and results in a smaller lever arm and thus less force that needs to be exerted by means 54 in lifting foundation 14 and wall 12. This configuration further reduces the amount of tipping force applied to the foundation 14 over that provided by prior art devices.

Figure 2:
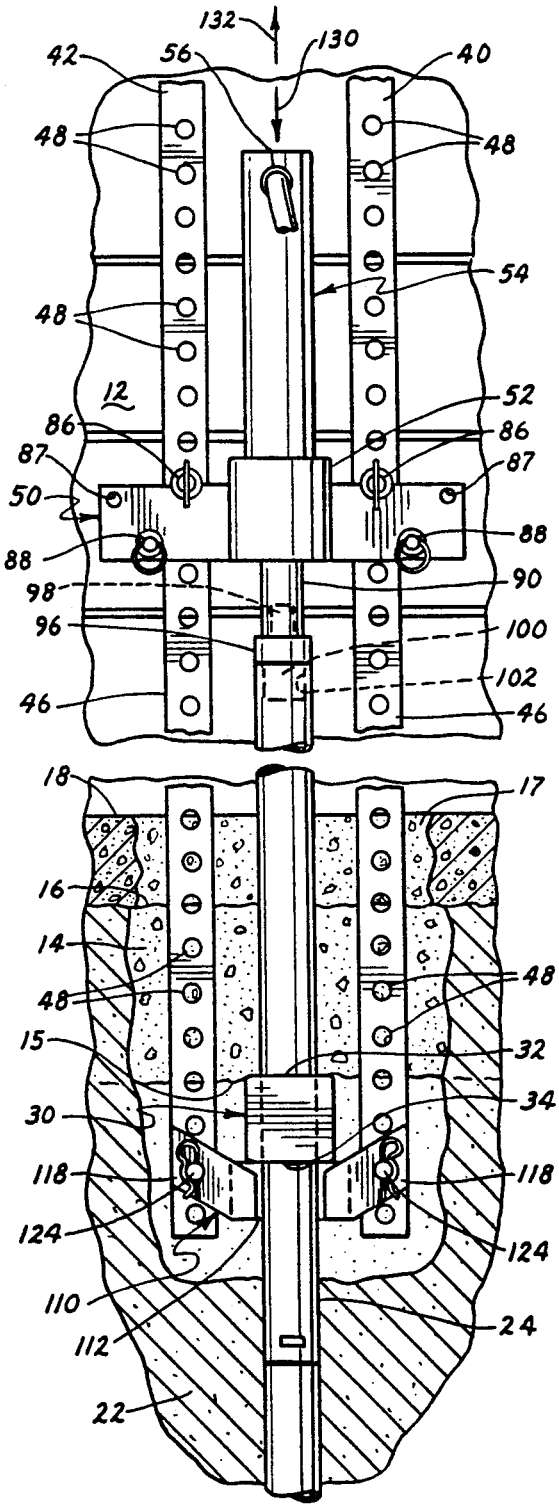
FIG. 2 is a partial rear elevation view of the apparatus of FIG. 1 taken along viewing plane 2—2 thereof.

FIGS. 4–7 represent an alternative embodiment to the support bracket/lifting cradle shown in FIGS. 1–3. Thus, as shown in FIGS. 4–7, the present device is useful with an integral support and lifting bracket 150. Bracket 150 includes a foundation support arm 152 having an upper surface 154 that engages bottom surface 15 of foundation 14. Bracket 150 further includes a pier-pipe guide means 156 having a bore 158 through which the pier-pipes 24 pass while being driven to form piling 26. Bracket 150 further includes a pair of laterally extending mounting or lifting plates 160 that are attached to and extend outwardly from opposite sides of guide means 156. Lifting plates 160 have a substantially planar configuration as shown in the Figures. Each plate 160 further includes a through hole 162 for attachment of bracket 150 to members 40 and 42. Support arm 152 is shown as having an I-beam configuration though other configurations, such as that shown in FIGS. 1–3 are within the purview of the present invention. Furthermore, bore 158 of guide means 156 may take on other configurations to match the particular configuration of the piling being driven.

Each member 40 and 42 includes a pair of downwardly depending attachment brackets 164 and 166 that are welded or otherwise permanently affixed to the lower ends of members 40 and 42. Attachment brackets 164 and 166 each include aligned through holes 168, best seen in phantom in FIG. 7. Attachment brackets 164 and 166 are spaced apart to receive therebetween a lifting plate 160. A pin 170 may be inserted through the aligned holes 168 of attachment brackets 164 and 166 and hole 162 of plate 160 to removably attach bracket 150 to members 40 and 42. In operation, bracket 150 will function to lift and support foundation 14 similarly to support bracket 30 and lifting cradle 110 as shown in FIG. 1. When the piling has been driven to the correct depth, the bracket 150 will be welded to the piling, pins 170 will be removed, and members 40 and 42 will be lifted upwardly out of the excavation along with yoke assembly 50.

The present invention provides means for lifting and stabilizing a sagging or sinking foundation that is readily operable in a confined region, either inside or outside the foundation. The excavation required to operate lifting apparatus 10 can be kept to a minimum by its small compact size and by its ability to exert a lifting force closer to the object to be lifted than prior art foundation stabilizers are able to do.

The present invention having thus been described, other modifications, alterations, or substitutions may now suggest themselves to those skilled in the art, all of which are within the spirit and scope of the present invention. It is therefore intended that the present invention be limited only by the scope of the attached claims below.

We claim:

1. Apparatus for stabilizing and supporting a structure subject to settling or sagging, said apparatus comprising:

a support bracket having a top and a bottom and adapted to extend generally horizontally under and to engage the structure to be supported and including guide means for receiving and guiding a support piling to be driven into the ground along a substantially vertical driving axis;

first and second generally upright members, each member having an elongate axis;

a yoke assembly located above said support bracket in vertically spaced relation thereto, said yoke extending transversely between said upright members;

restraining means on said upright members in restraining engagement with said yoke;

a power cylinder means having an elongate axis in substantial alignment with said vertical driving axis for driving the support piling into the ground, said power cylinder means attached to said yoke and comprising a cylinder, a piston reciprocally moveable within said cylinder and a piston rod attached to said piston, whereby upward reaction forces generated by the extension of said piston with resultant driving force against said support piling acts on said yoke; and means, engaging the bottom of said bracket at a location between the structure and the piling, for transmitting pile driving reaction forces to said bottom of said support bracket to lift and stabilize the structure, said means for transmitting attached to said upright members for upward movement therewith.

2. The apparatus of claim 1 wherein said power cylinder means has a threaded lower end and said yoke assembly includes a threaded sleeve to threadably receive said power cylinder means.

3. The apparatus of claim 1 wherein said reaction forces transmitting means comprises laterally extending cradle means having outer ends and a transverse segment therebetween that engages the bottom of said support bracket, said cradle means being attached at its outer ends to said upright members to permit said transverse segment to transmit pile driving generated reaction forces through said upright members to said support bracket for lifting and supporting the structure.

4. The apparatus of claim 3 wherein:

each said upright member includes a plurality of through holes extending through said member substantially transversely to said elongate axis, said plurality of holes being in a vertically spaced relation; and said outer ends of said cradle means are apertured to receive attachment pins removably inserted through selected, horizontally aligned pairs of holes in said upright members.

5. The apparatus of claim 3 wherein:

each said upright member includes a plurality of through holes extending through said member substantially transversely to said elongate axis, said plurality of holes being in a vertically spaced relation; and said restraining means are removably and selectively engagable in predetermined, horizontally aligned pairs of said holes.

6. The apparatus of claim 5 wherein said restraining means comprise pins removably inserted through said holes.

7. The apparatus of claim 6 wherein said yoke assembly includes a pair of laterally extending wings, each of said wings including a notch bearing against said pins.

8. The apparatus of claim 7 wherein said wings comprise first and second pairs of spaced apart arm members respectively receiving therebetween said first and second upright members.

9. The apparatus of claim 8 wherein each of said spaced apart arm members includes a stop means extending therebetween for restraining said upright members from rotating about their respective pinned attachments to said cradle means.

10. The apparatus of claim 7 wherein said upright members are held in substantially parallel relation to each other during the extension of said piston by the engagement of said members with said yoke assembly and said cradle means.

11. The apparatus of claim 3 wherein said cradle means outer ends comprise first and second pairs of spaced apart plates respectively receiving said first and second members therebetween and attached thereto.

12. The apparatus of claim 1 wherein said piston rod extends downwardly from said cylinder and has a threaded end and further including a piston rod adapter, said adapter including a threaded end for threadably engaging said piston rod threaded end, said adapter further including means for drivingly engaging the top of the piling driven into the ground.

13. The apparatus of claim 1 wherein said piston rod extends downwardly from said cylinder for driving engagement with the top of the piling driven into the ground.

14. The apparatus of claim 1 wherein:

each said upright member includes a plurality of through holes extending through said member substantially transversely to said elongate axis, said plurality of holes being in a vertically spaced relation; and said restraining means are removably and selectively engagable in predetermined, horizontally aligned pairs of said holes.

15. The apparatus of claim 14 wherein said restraining means comprise pins removably inserted through said holes.

16. The apparatus of claim 15 wherein said yoke assembly includes a pair of laterally extending wings, each of said wings including a notch bearing against said pins.

17. The apparatus of claim 16 wherein said wings comprise first and second pairs of spaced apart arm members respectively receiving therebetween said first and second upright members.

18. Apparatus for stabilizing and supporting a structure subject to settling or sagging, said apparatus comprising:

a support bracket adapted to extend generally horizontally under and to engage the structure to be supported and including guide means for receiving and guiding a support piling to be driven into the ground, said support bracket further including a pair of mounting plates affixed to said guide means and projecting laterally outwardly therefrom on opposite sides of said guide means;

first and second generally upright members, each member having an elongate axis and a plurality of through holes extending through said member substantially transverse to said elongate axis, said plurality of holes being in a vertically spaced relation, and said support bracket being removably attached to the bottom ends of said upright members;

a yoke assembly located above said support bracket in vertically spaced relation thereto, said yoke assembly being removably engageable with and reciprocally vertically movable relative to said members;

a power cylinder means for driving the support piling into the ground, said cylinder means attached to said yoke and comprising a cylinder, a piston reciprocally moveable within said cylinder and a piston rod attached to said piston and extending downwardly therefrom outside of said cylinder; and a transmitting means comprising laterally extending cradle means having outer ends and a transverse segment therebetween that engages the bottom of said support bracket, said cradle means being attached at its outer ends to said upright members to permit said transverse segment to transmit pile driving generated reaction forces through said upright members to said support bracket for lifting and supporting the structure.

* * * * *